United States Patent [19]

Deola

[11] Patent Number: 4,949,951

[45] Date of Patent: Aug. 21, 1990

[54] BODY BUILDING EXERCISE DEVICE

[76] Inventor: James A. Deola, Ladow Ave., Apt. 23A Cumberland Green Apts., Millville, N.J. 08332

[21] Appl. No.: 415,032

[22] Filed: Oct. 2, 1989

[51] Int. Cl.[5] ..... A63B 21/00

[52] U.S. Cl. ..... 272/134; 272/118; 272/143; 272/144

[58] Field of Search ..... 272/94, 96, 97, 117, 272/118, 130, 132, 134, 136, 143, 144

[56] References Cited

U.S. PATENT DOCUMENTS

| | | | |
|---|---|---|---|
| 4,452,445 | 6/1984 | Lepley et al. | 272/130 X |
| 4,542,899 | 9/1985 | Hendricks | 272/118 |
| 4,614,338 | 9/1986 | Castillo | 272/117 |
| 4,629,185 | 12/1986 | Amann | 272/134 X |
| 4,650,183 | 3/1987 | McIntyre | 272/96 |
| 4,757,992 | 7/1988 | Heitsch et al. | 272/134 |
| 4,768,779 | 9/1988 | Oehman, Jr. et al. | 272/134 X |
| 4,799,671 | 1/1989 | Hoggan et al. | 272/118 |

FOREIGN PATENT DOCUMENTS 2167967 6/1986 United Kingdom .

*Primary Examiner*—Robert W. Bahr
*Attorney, Agent, or Firm*—Thomas A. Lennox

[57] ABSTRACT

A body building exercise device is provided on a frame with a vertically positioned inverted "U" shaped member pivotally connected to the frame at a median position. The lower ends of the "U" shaped member are connected to a weight stack through a cable and pulley mechanism. Two bar members are connected at one end through a universal connection to the bottom ends of the first member. At the free ends of the bar, gripping means are provided to allow a "dumbbell fly" movement of the bar members to attain constant forward push force level requirements in an equidistant plane in relation to the user's body, independent of the resisting force supplied to the device from the weigh stack.

9 Claims, 3 Drawing Sheets

BODY BUILDING EXERCISE DEVICE

BACKGROUND OF THE INVENTION

This invention involves a body building exercise device and in particular provides a device to develop the chest or pectoral muscles.

There are two basic free weight movements utilized to develop the chest or pectoral muscles. The first movement is the straight out push away from the chest with a bar bell device. This exercise is generally undertaken while lying on the back and is known as the "bench press". The second type of movement, known as the "dumbbell fly" is a circular motion with a person's hands originating from the sides of the body, again while lying on the back. The person's arms are almost fully extended horizontally out to the sides and move through an equidistant plane from that starting position, up to above the front of the person's chest, until the hands meet above the chest, the arms remaining almost fully extended. While there is substantial strain developed by the intended movement, as the dumbbells are lifted from the person's sides, the resisting forces required by the pectoral muscles necessary to support the dumbbells deceases as the arms approach vertical. In fact, when the arms are vertical, the dumbbells are supported by the vertical shafts of the arms, with little or no strain on the pectoral muscles. Thus, during the movement of the arms, during the dumbbell fly, the force relationship between the upward push force required to lift the dumbbells decreases considerably such that the full potential of the exercise is lost as the arms are brought to the vertical position.

None of the exercise devices developed to the date improve the free weight dumbbell fly exercise to provide an equidistant unrestricted, variable force during the dumbbell fly circular motion, nor do they attain the objects and advantages described herein below.

SUMMARY OF THE INVENTION

It is an object of this invention to provide a device to perfect the unrestricted forces supplied by the user through the circular fly motion such that the resulting resisting forces during the motion can be varied to create the desired force relationship between the forward push force required and the equidistant force required.

It is a further object of the invention to increase the equidistant force requirements while maintaining a constant forward push or press force level for superior contraction and development of the pectoral or chest muscles.

It is an additional object of the present invention to provide an exercise device to advance the existing free weight dumbbell fly motion such that there is virtually zero equidistant force variation.

It is an object of the exercise device of this invention to enable a person to push on the ends of two bars with the person's hands and move the hands in a three dimensional plane pushing against a resisting force, wherein the movement is unrestricted and essentially allows development of all of the chest muscles.

It is an object of this invention that the exercise device have the ability to create and also vary at will the resulting forces supplied to the user by the device in an equidistant plane in relation to the user's body. This equidistant plane is essentially around the center line of the body and is most easily pictured with the person standing erect with the plane encircling the body in essentially vertical position.

It is a specific object of the present invention to be able to adjust the device to provide an increasing or decreasing equidistant force to move against a single adjustable resisting force, such as lifted weights attached to a cable.

It is an object of the present invention to provide a universal mechanism wherein the device can be used to develop a person's arms or legs to fully develop or rehabilitate the muscles of the body through the pushing or pulling of the mechanism through a full range of unrestricted three dimensional motions all coupled with the capability of creating and varying the resisting force in a plane equidistant from the person's body.

The invention is a device on which a person can exercise, the device including a frame and resisting force means to provide a resisting force. The device further includes force directing means supported on the frame, connected to the resisting force means, that includes two connection points separated from each other equidistant from a center line of the device, preferably aligned vertically, to provide movement of the connection points against the resisting force means, preferably along two parallel lines. The device also includes grasping means comprising two handles, the grasping means being attached to the force directing means through universal connecting means at the connection points allowing attachment with pivotal movement in all directions. The grasping means provides movement of the handles against the resisting force in a plane equidistant around the center line.

It is preferred that the force directing means be pivotally supported on the frame. It is further preferred that the force directing means include a member pivotally supported on the frame at a median point along the member. It is also preferred that the force directing means include a "U" shaped member pivotally supported on the frame at a median point along the member. It is further preferred that the "U" shaped member be pivotally supported in a vertical alignment on the frame. It is also preferred that the grasping means comprises two members each having first and second ends with the first ends attached to the force directing means and the handles be positioned proximate the second ends. It is more preferred that the two members be of adjustable length. It is further preferred that the connection points be positioned proximate the free ends of the "U" shaped member. It is also preferred that the handles include leg grasping means to attach to a person's leg or foot.

The invention is also a body building exercise device that includes a frame and a first member, preferably inverted "U" shaped, supported on the frame that includes a median position. The device further includes pivot means to connect the median position of the first member to the frame and to allow the member to pivot at the median position to allow the connection points of the first member to move on two lines, preferably essentially parallel to each other, equally spaced apart from the median position. The device further includes force means connected to the connection points of the first member to provide a resisting force against movement of the connection points of the first bar along the two lines. The device also includes second and third members each having a first position and a second position, the positions preferably separated from each other along the lengths of the second and third members, and universal connecting means to separately connect the first positions of the second and third members to the connection points of the first member and to allow pivotal movement of the second and third members in all directions with respect to the connection points. The device further includes gripping means proximate the second positions of the second and third members to allow gripping of appendages of the person's body, such as by the hands to the second and third members, wherein movement of the gripping means is in a plane equidistant around the median position.

DESCRIPTION OF PREFERRED EMBODIMENTS

Figure 1:
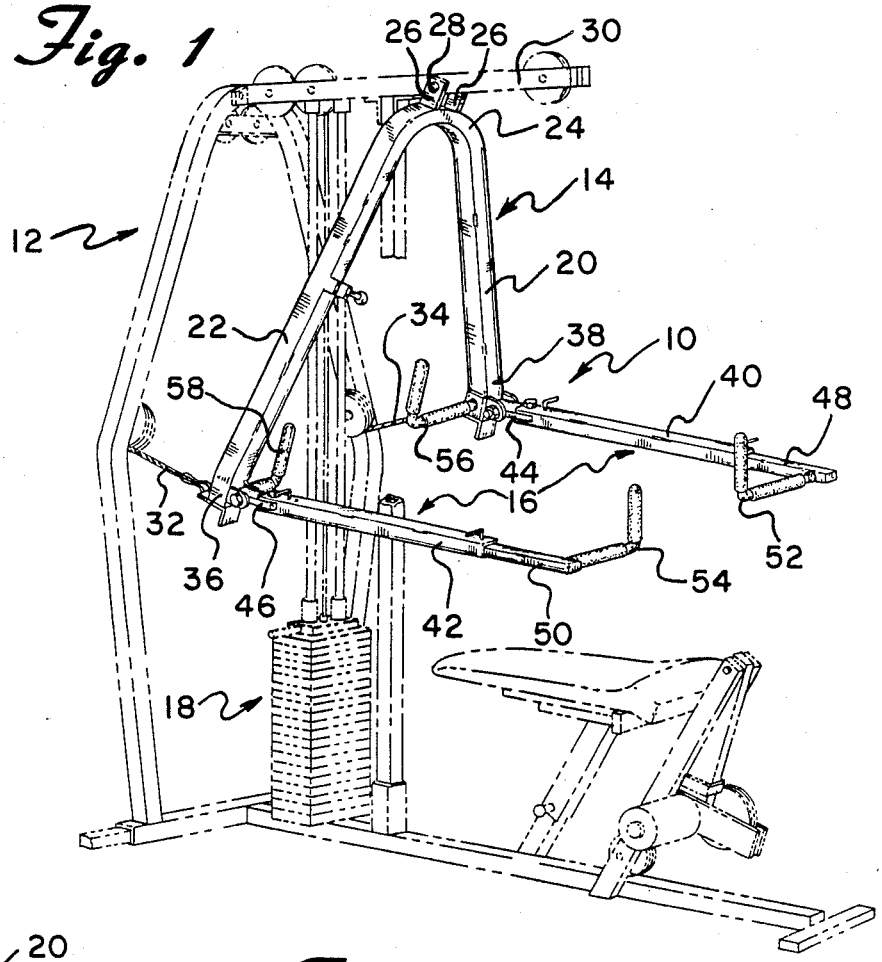
FIG. 1 is a perspective view of a body building exercise device according to the present invention.

The mechanism includes a three member linkage system that is pivoted at a connection point to a fixed member on a frame of exercise equipment. A first bar pivots at the fixed connection point traveling in swinging arcs, generally horizontally. Second and third bars are joined by way of a bi-directional universal pivot mechanism and are free to move three dimensionally from the bi-directional pivot points. The first bar is preferably a "U" shaped bar, more preferably an inverted "U" shaped, such that both legs of the "U" shape travel the joining bi-directional pivot points of the second bars, thus creating two three dimensional pivoting bars, a certain distance apart, one on each side of person's body using the apparatus. This dual bar, three dimensional pivoting system is connected to a resisting force such as a stack of 10 pound plates used in standard exercising equipment with the number of plates being lifted being adjustable. Cams and other force variation devices can be used in conjunction with the mechanism to create different results. The person can pull on hand held grips attached to both ends of the first bar, near the joining three dimensional pivot points. The person can also push at the end of the second and third bars of the mechanism or undertake a pull and push exercise utilizing each grip position. Finally, and most importantly, the second and third bars may be pulled together in an improved "dumbbell fly" movement. It is an object of this device to enable a person to pull on the free ends of the second and third bars with his or her hands in a three dimensional plane pushing against a resisting force. This unrestricted movement is essential to completely develop all of the muscle groups of the chest. A further major objective and key feature of the mechanism is the ability to create and also vary the resulting forces supplied to the user by the mechanism in an equidistant plane in relation to the user's body. This is extremely important to the development of the pectoral muscles as well as the connecting muscles of most other muscle groups in the area. The universal device described herein can be used by either a person's arms or legs to fully develop or rehabilitate the muscles of one's body through the pushing or pulling the mechanism through a full range of unrestricted three dimensional motions coupled with the key capability of creating and varying the resisting force in the plane equidistant from the person's body.

The device described hereinbelow can be manufactured in a variety of shapes and sizes and materials. The device includes a first bar pivotally affixed at one end to a rigid part of an exercise machine having a resistible force available such as a stack of steel weights. Rubber-band resisting force or even gas, hydraulic or other types of cylinder type single or by bi-directional resisting forces can be used. The first bar is made from a two inch by two inch by ⅛ inch wall steel tubing bend in a "U" shape to the two sides of the user's body. The first bar can also be split at the apex of the "U" shape and consist of two individual bars, one to each side of the user's body such that the individual bars can be connected to separate resisting forces and be pushed or pulled independently of each other. This independence of the two sides of the mechanism is important for certain types of muscle rehabilitation and is therefore disclosed herein as a possible modification of the single "U" shaped bar design. The independent bars would be conneced through the same pivot point at the fixed location on the exercise frame.

Another modification of the device is to locate the fixed pivot point of the first bar at a location near the floor rather than over head. This would result in the same motion of the first bar only through a downward radius as opposed to the upward swing radius of the first bar mechanism described hereinbelow.

The device also includes pivot point joining of the second and third bars of the mechanism to the first bar. These two pivot points are three dimensional pivoting devices allowing the second and third bars to move in any direction originating at those pivot points. Although the device described hereinbelow is preferred the pivot can be constructed of a simple piece of rubber allowing movement in all directions, or any other type of joint mechanism that provides three dimensional movement.

The mechanism includes second and third bars which are illustrated and described below as being of an adjustable length. However, the length of these bars may be fixed designed to meet, for example at a 45 degree angle in the "dumbbell fly" movement. The telescoping tubes that are made adjustable enable the equidistant movement force to be varied in relation to the force created through the inward and outward movement to and from the person's body. Inasmuch as the resistant force device may be varied, and the length of the arms varied to also adjust the force, the machine may provide a different "feel" and an adjustable relationship between the two movement forces. As the second and third bars are reduced in length, the force required in the "dumbbell fly" movement is substantially increased with the same resisting force. The amount of force required is almost unlimited.

The device also includes connecting means between the grasping means and the resisting force to which the user can push or pull against the resisting force. A mechanism may be provided to lock the second and third bars up out of the way against the first bar so that the grips near the joining pivoting points of the bars may be utilized to pull against the resisting force. Since the second and third bars easily pivot to adjacent positions along the length of the first bar, a variety of simple holding mechanisms can be utilized. Holster type grasping means attached to the second and third bars can be utilized for leg exercises such that the person's foot would be securely inserted into the holster to push or pull on the multiple bar mechanism.

In FIG. 1, exercise device 10 is illustrated and supported on frame device 12 shown here in a shadow view to emphasize the elements of the invention. Device 10 includes force directing device 14 which includes an inverted "U" shaped member with downwardly directing left arm 20 and downwardly directed right arm 22 with median section 24 at the top end of the inverted "U" shape. Hinge bracket 26 is welded to median section 24 extending upwardly with two separate members through which mating holes are provided in which horizontal pivot pin 28 passes and engages horizontal frame member 30 allowing device 14 to pivot in a vertical plane. Resisting force device 18 includes cable end 32 connected to bottom end 36 of right arm 22 and cable end 34 connected to bottom end 38 of left arm 20 and provides a resisting force against the movement of device 14 pivoting in an arc in a forward direction. Resisting force device 18 also specifically resists movement of ends 36 and 38 in parallel lines of travel on large radius arcs that are generally horizontal in this configuration. Grasping device 16 provides movement of handles against resisting force device 18 in a plane equidistant around a center line illustrated in a later view. Grasping device 16 includes left force directing member 40 and right force directing member 42, each of these member having two ends. At one end, member 40 is connected through universal connection device 44 to bottom end 38 of left arm 20. Universal connection device 44 allows pivotal movement three dimensionally. At the other end of member 40, generally described as the "free end" is front end hand grip 52 which is structurally connected to extensible members 48 which telescopes in and out of hollow member 40 to provide adjusted extendibility of member 40. Likewise, right force directing member 42 has two ends, with one end connected through universal connection device 46 to bottom end 36 of right arm 22. Again, device 46 provides a universal connection allowing three dimensional movement at that pivot point. At the "free end" of right member 42 is extensible member 50 telescoping in and out of member 42 with right front hand grip 54 structurally attached to member 50. Structurally attached and extending from bottom ends 36 and 38 of device 14 are right rear hand grip 58 and left rear hand grip 56. These latter hand grips are "L" shaped members with one leg attached horizontally to the bottom ends of device 14 and with the other leg of the "L" shape extending upwardly allowing the person using the device to grip and pull or push ends 36 and 38 against resisting force device 18. Likewise, hand grips 52 and 54 on the free ends of grasping device 16 are also "L" shaped members with one leg horizontal and the other leg vertical allowing the person to grip and pull or push grasping device 16 against resisting force device 18.

Figure 2:
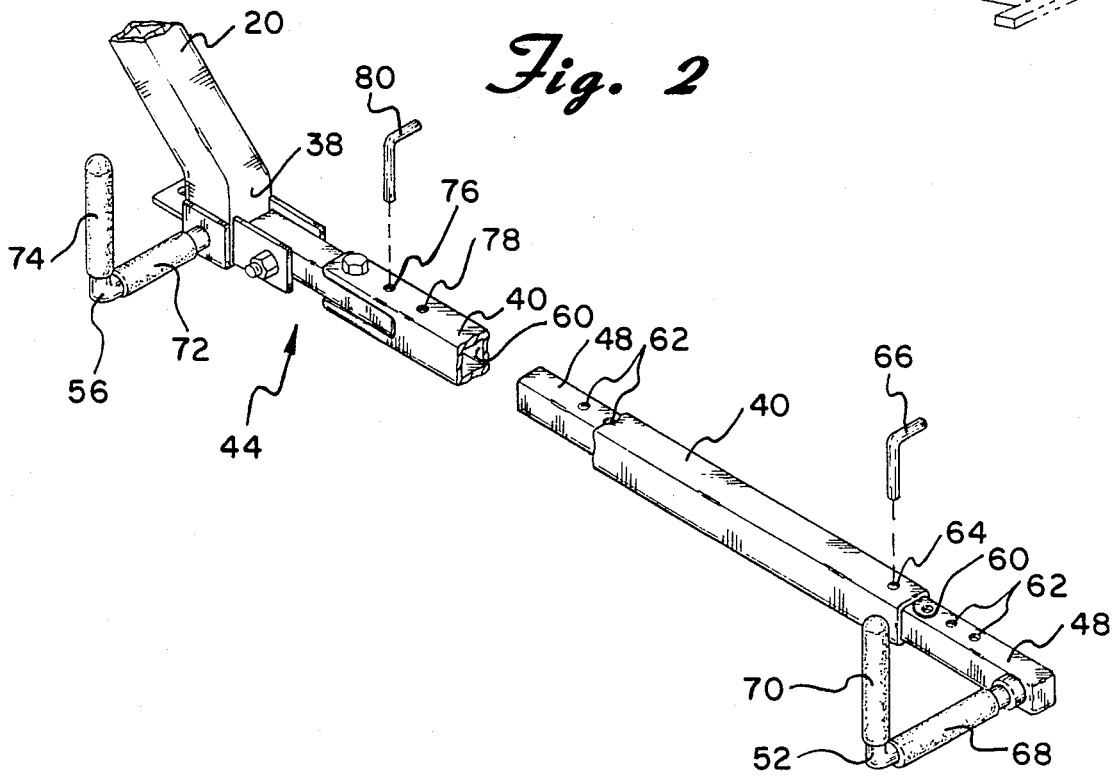
FIG. 2 is a perspective view of one of the two grasping means of the device.
Figure 3:
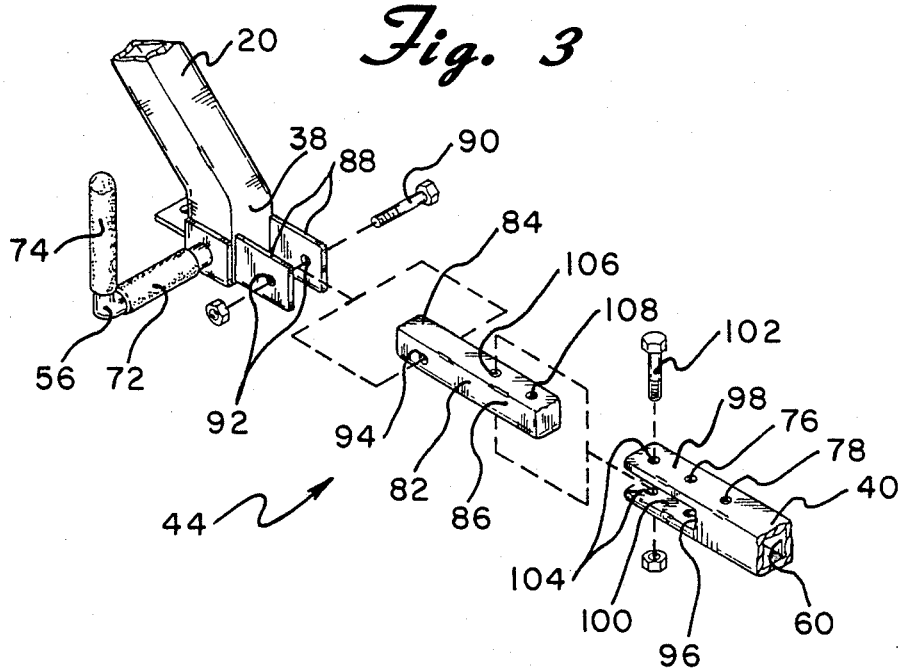
FIG. 3 is a cut-away perspective view of the universal connecting means of the device.

As further illustrated in FIGS. 2 and 3, left force directing member 40 together with universal connection device 44 is expanded and shown in greater detail. Right force directing member 42 and universal connection device 46 are constructed identically and are the mirror images thereof. Extensible member 48 freely slides inside longitudinal opening 60 of hollow steel tube 40. A multiplicity of holes 62 are provided vertically through member 48 spaced along its length. Vertical hole 64 is drilled through the free end of force directing member 40 with "L" shaped pin 66 insertable through holes 64 and through any of the holes 62 to lock members 48 and 40 together at a chosen length. Front left hand grip 52 includes horizontal leg section 68 and vertical leg section 70 to allow the person using the apparatus to grip the free end of member 40 with the wrist pronated 90 degrees in either direction. Likewise, rear left hand grip 56 extending from end 38 includes horizontal leg section 72 and vertical leg section 74 again to allow gripping in multiple positions. It is desirable that universal connection device 44 allow three dimensional movement while also being able to be locked into two dimensional movement, in this case locked into vertical planar movement only. When pin 80 is inserted into hole 76 through member 40, the pivoting of connection device 44 is locked such that only vertical pivoting is possible. When pin 80 is inserted into storage hole 78, universal connection device 44 is free to rotate in three directions. Universal connection device 44 includes pivot link member 82 which is about three inches long with end 84 and free end 86. Pivot link 82 is a solid steel bar which provides the linkage between the members for three dimensional movement. End 84 interfits between two vertical members of pivot bracket 88. Pivot bolt 90 inserts through horizontal holes 92 through the two bracket members 88 which are structurally attached to end 38, and through horizontal hole 94 in end 84 of link 82 allowing pivot link 82 to pivot in a vertical plane. Horizontal movement is attained by cutting out the vertical side walls of hollow square tube 40 at the connecting end forming upper wall 98 and lower wall 100. Bolt 102 is vertically positioned and extends down through vertical holes 104 cut through walls 98 and 100. End 86 of pivot link 82 is inserted between walls 98 and 100 with holes 106 drilled vertically through end 86 of pivot length 82. Bolt 82 is inserted and held in position by a nut through holes 104 and 106 allowing member 40 to pivot in a horizontal plane. At the far end of end 86 of link 82 vertical hole 108 is drilled which, when link 82 is held in position by bolt 102 is aligned under hole 76. When pin 80 is inserted through hole 76 into hole 108, link 82 is locked into position and no horizontal pivot movement is possible. When full three dimensional movement is desired, pin 80 is inserted into hole 78 which is positioned further along member 40, away from link 82 so as not to interfere with horizontal pivotal movement. Universal connection devices 44 and 46 utilize two 90 degree opposed pivots on a single link.

Figure 4:
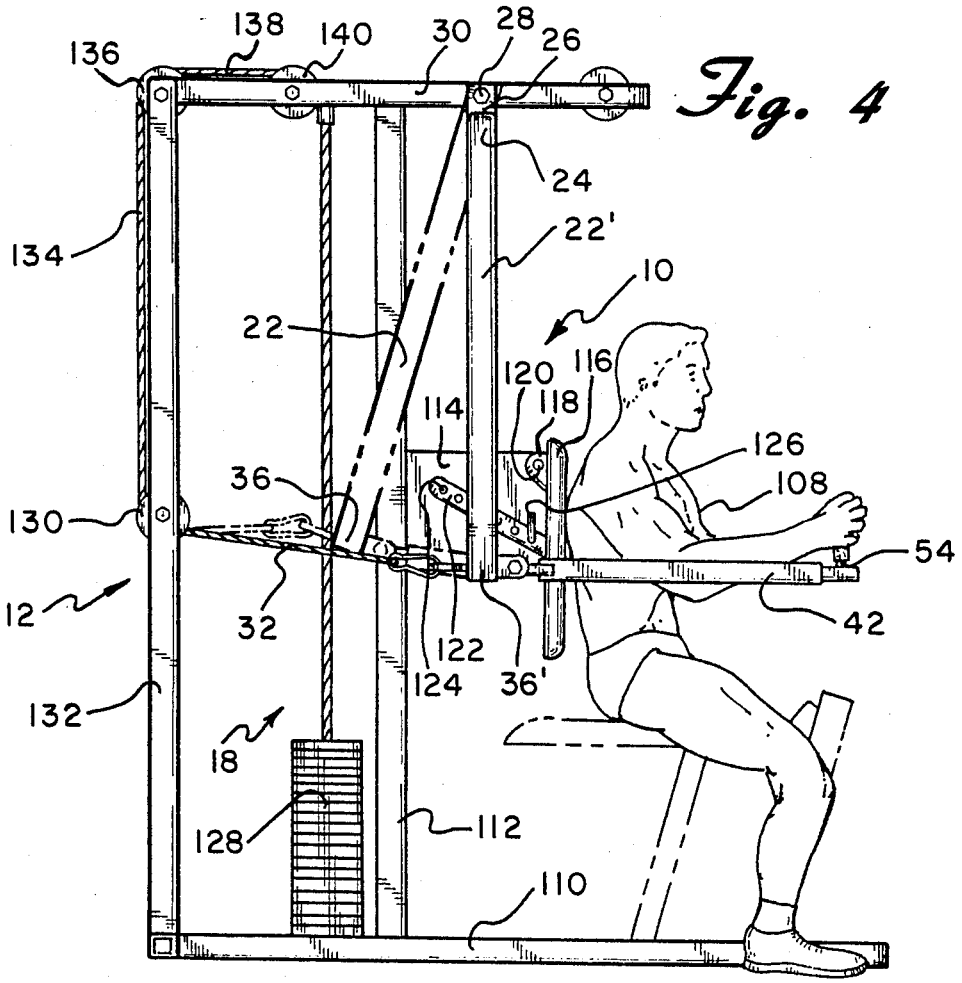
FIG. 4 is a side elevational view of the device illustrated in FIG. 1.

In FIG. 4, person 108 is using the device sitting on a seat attached to base frame 110 which is part of frame device 12. Vertical frame member 112 extends vertically upwardly attached to base frame 110 and upper frame member 30. Support member 114 is a vertical plate attached to vertical frame member 112 extending toward the person and toward the front of device 10. Padded back support member is vertically positioned in this view with vertical pivot bracket 118 structurally attached to the back of member 116. Pivot pin 120 horizontally connects vertical pivot bracket 118 with support member 114 allowing back support 116 to pivot in a vertical plane. Angle support member 122 is structurally attached to the back of back support 116 extending and abutting plate 112. A multiplicity of holes 124 are drilled through member 112 along its length and pin 126 is inserted into any chosen hole to engage a horizontal hole, hidden in this view, through support member 114. Thus, back support 116 may be positioned and held at any chosen angle. Resisting force device 18 includes continuous running cables from ends 36 and 38 to standard weight stack 128. The cable from end 36 is shown in this view as cable end 32 is attached through a spring clip to end 36 being trained horizontally to pulley 130 supported on rear frame member 132 which is part of frame device 12 between members 30 and 110. The cable is trained upwardly in a vertical direction as section 134 to left upper pulley 136 rotatably connected at the upper end of frame member 132. The cable is trained horizontally toward the front device 10 as section 138 to front upper pulley 140 which is rotatably connected on upper horizontal frame member 30 above weight stack 128. The cable is then trained downwardly in a vertical position from pulley 140 to connect with weight track 128 to lift any chosen number of plates that provide the resisting force to movement of end 36. The cable connection from end 38 is essentially identical to that just described for end 36, providing an equal resisting force to movement of end 38. The pivoting movement of force directing device 14 is illustrated by movement of right arm 22 to position of right arm 22' by pulling against resisting force device 18 provided through cable section 32 attached to end 36 which is moved to position 36'.

Figure 5:
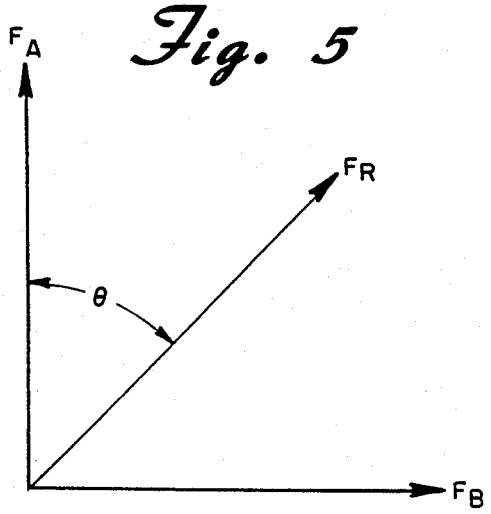
FIG. 5 is a diagram illustrating the relationship between the forces involved in operating the device of the present invention.
Figure 6:
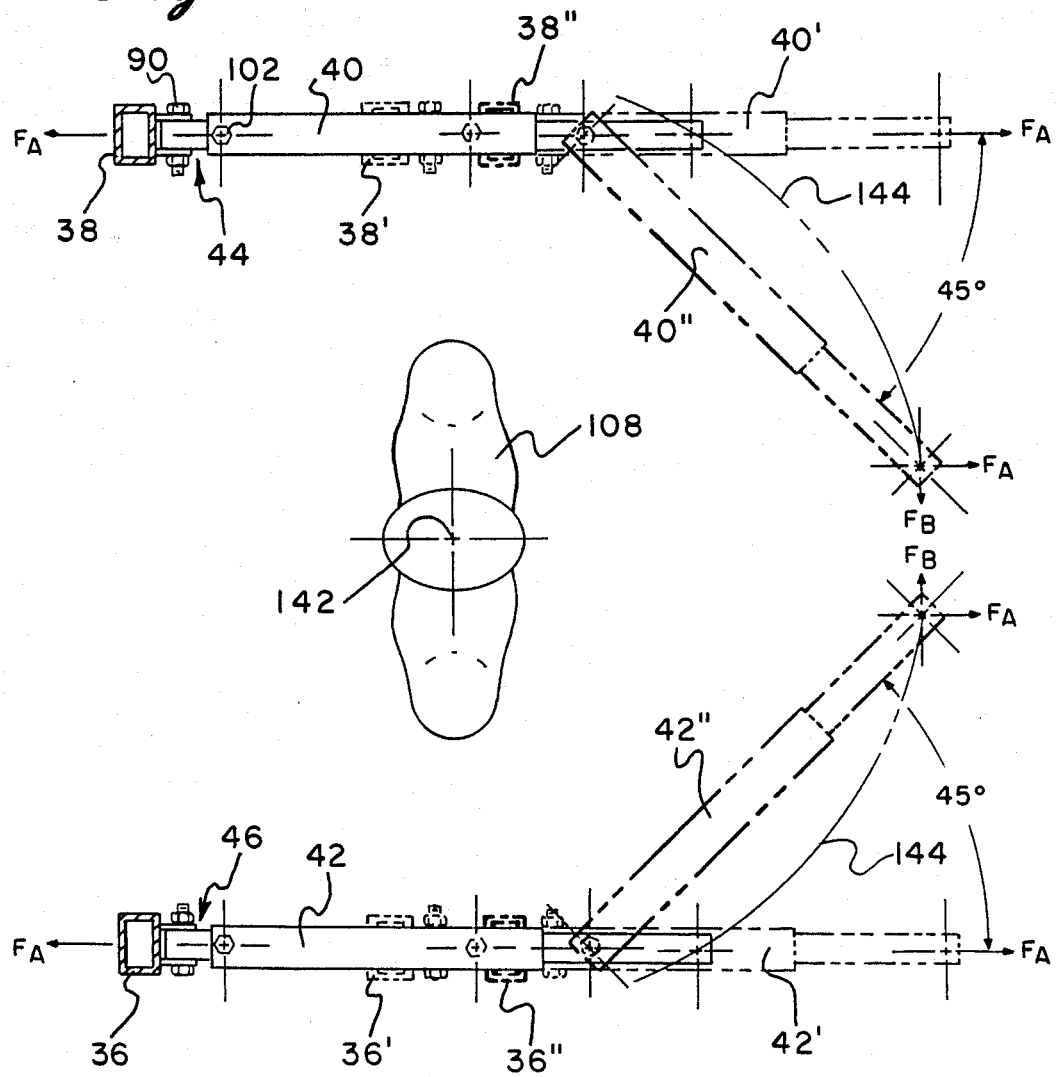
FIG. 6 is a top diagram view illustrating the movement of the force directing means and the grasping means in the "bench press" movement and in the "dumbbell fly" movement.

The force relationships are illustrated in the diagram of FIG. 5 wherein $F_A$ is the straight out push force required by the user with each of his or her arms and is equal to the force resistance providing by resisting force device 18. Force vector $F_B$ is the force at 90 degrees necessary to bring the ends of members 40 and 42 together if the force were at right angles. Force vector $F_R$ is the actual combined force necessary to carry out the "dumbbell fly" movement. With pin 20 in hole 76, movement of end 38 to position 38' and end 36 to position 36' as illustrated in FIG. 6, will require that $F_A$ equal the resisting force. In FIG. 6, the position of left force directing member 40 and right force directing member 42 is illustrated. With pin 80 in hole 76 and horizontal pivot movement prevented for both arms 40 and 42, straight push or pull movement to positions 40' and 42'' can be accomplished. In this movement ends 36 and 38 move to positions 36' and 38'. When pin 80 is placed in holding hole 78 and members 40 and 42 are free to pivot in a horizontal plane, the "dumbbell fly" movement can be accomplished. In this movement, members 40 and 42 are pulled and angled to positions 40'' and 42''. The movement of arm 40 to position 40'' and of arm 42 to position 42'' is equidistant movement in relation to the user's body in an equidistant plane. When the length of these members are such that they are angled to 45 degree angles as the ends 48 and 50 come together, the forces required $F_B$ will be equal to $F_A$. In this example, if $F_A$ equals 25 pounds and angle theta is equal to 45 degrees, then $F_R$ equals $F_A$ divided by the cosine of theta equaling 35.36 pounds. $F_B$ equals $F_R$ times the sine of theta which is 25 pounds. On the other hand, if the length of arms of 40 and 42 are reduced, for example, from two feet to 1½ feet in length, it will require further movement of ends 36 and 38 beyond positions 36'' and 38' as shown for 45 degrees, to bring ends 48 and 50 together. If the angle necessary to bring them together is 65 degrees, then $F_R$ is 59.16 pounds when $F_B$ is 25 pounds and $F_C$ is 53.6 pounds. Further shortening of members 40 and 42 increases $F_R$ the amount of force required to bring the ends together. As angle theta is varied by adjusting the length of the members 40 and 42, force $F_B$ is increased or decreased relative to $F_A$. As illustrated in FIG. 6, center line 142 is a vertical line through the person using the device and arc 144 is the plane of movement equidistant from the person.

While this invention has been described with reference to the specific embodiments disclosed herein, it is not confined to the details set forth and the patent is intended to include modifications and changes which may come within and extend from the following claims.

I claim:

1. A body building exercise device comprising:

(a) a frame, (b) a first member supported on the frame comprising a median position and two connection points on opposite sides of the median position, (c) pivot means to connect the median position of the first member to the frame and to allow the member to pivot at the median position to allow the connection points of the first member to move on two lines equally spaced apart from the median position, (d) force means connected to the first member to provide a resisting force against movement of the connection points of the first bar along the two lines, (e) second and third members each having a first position and a second position, (f) universal connecting means to separately connect the first positions of the second and third members to the connection points of the first member and to allow pivotal movement of the second and third members in all directions with respect to the connection points, and (g) gripping means proximate the second positions of the second and third members to allow gripping of appendages of the person's body to the second and third members, wherein movement of the gripping means is on a plane equidistant around the median position.

2. The device of claim 1 wherein the lines of movement of the connection points are parallel.

3. The device of claim 1 wherein the first and second positions on the second member are separated from each other along the length of the second member, and the first and second positions on the third member are separated along the length of the third member.

4. The device of claim 1 wherein the first member comprises a "U" shaped member.

5. The device of claim 4 wherein the "U" shaped member is pivotally supported in a vertical alignment on the frame.

6. The device of claim 4 wherein the connection points are positioned proximate the free ends of the "U" shaped member.

7. The device of claim 1 wherein the gripping means comprises handles positioned proximate the second positions on the second and third members.

8. The device of claim 7 wherein the handles comprise leg grasping means to attach to a person's leg or foot.

9. The device of claim 1 wherein the second and third members are of adjustable length.

* * * * *

US004949951C1

(12) EX PARTE REEXAMINATION CERTIFICATE (5708th)

United States Patent
Deola

(10) Number: US 4,949,951 C1
(45) Certificate Issued: Mar. 20, 2007

(54) BODY BUILDING EXERCISE DEVICE

(76) Inventor: James A. Deola, Ladow Ave., Apt. 23A, Cumberland Green Apts., Millville, NJ (US) 08332

Reexamination Request:
No. 90/006,830, Oct. 28, 2003

Reexamination Certificate for:

| | |
|---|---|
| Patent No.: | **4,949,951** |
| Issued: | **Aug. 21, 1990** |
| Appl. No.: | **07/415,032** |
| Filed: | **Oct. 2, 1989** |

(51) Int. Cl.
*A63B 23/035* (2006.01)
*A63B 23/12* (2006.01)

(52) U.S. Cl. ..... 482/138; 482/100
(58) Field of Classification Search ..... 428/100.138
See application file for complete search history.

(56) References Cited

U.S. PATENT DOCUMENTS

| | | | | |
|---|---|---|---|---|
| 2,921,791 A | | 1/1960 | Berne | |
| 3,640,527 A | * | 2/1972 | Proctor | 482/100 |
| 4,452,447 A | | 6/1984 | Lepley et al. | |
| 4,542,899 A | | 9/1985 | Hendricks | |
| 4,614,338 A | | 9/1986 | Castillo | |
| 4,629,185 A | | 12/1986 | Amann | |
| 4,650,183 A | | 3/1987 | McIntyre | |
| 4,757,992 A | | 7/1988 | Heitsch et al. | |
| 4,768,779 A | | 9/1988 | Oehman, Jr. et al. | |
| 4,799,671 A | | 1/1989 | Hoggan et al. | |
| 4,844,456 A | * | 7/1989 | Habing et al. | 482/100 |
| 4,964,632 A | * | 10/1990 | Rockwell | 482/100 |
| 4,986,538 A | * | 1/1991 | Ish, III | 482/138 |

FOREIGN PATENT DOCUMENTS

GB 2167967 6/1986

OTHER PUBLICATIONS

Corbin–Pacific Advertisement, National Strength & Conditioning Association Journal, Apr.–May 1982.
Pyramid Fitness Arm Curl and Upright Row Advertisement.

* cited by examiner

*Primary Examiner*—Michael O'Neill

(57) ABSTRACT

A body building exercise device is provided on a frame with a vertically positioned inverted "U" shaped member pivotally connected to the frame at a median position. The lower ends of the "U" shaped member are connected to a weight stack through a cable and pulley mechanism. Two bar members are connected at one end through a universal connection to the bottom ends of the first member. At the free ends of the bar, gripping means are provided to allow a "dumbbell fly" movement of the bar members to attain constant forward push force level requirements in an equidistant plane in relation to the user's body, independent of the resisting force supplied to the device from the weigh stack.

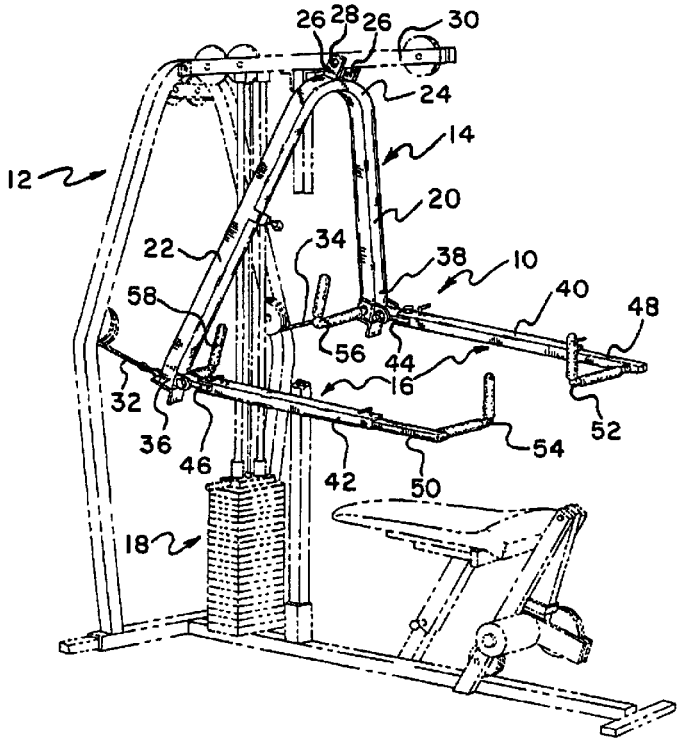

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1 and 3 are determined to be patentable as amended.

Claims 2, and 4–9, dependent on an amended claim, are determined to be patentable.

New claims 10–17 are added and determined to be patentable.

1. A body building exercise device comprising:

(a) a frame, (b) a first member supported on the frame comprising a median position and two connection points on opposite sides of the median position, (c) pivot means to connect the median position of the first member to the frame and to allow the member to pivot at the median position to allow the connection points of the first member to move on two lines equally spaced apart from the median position, (d) force means connected to the first member to provide a resisting force against movement of the connection points of the first bar along the two lines, (e) second and third members each having a first position and a second position, (f) universal connecting means to separately connect the first positions of the second and third members to the connection points of the first member and to allow pivotal movement of the second and third members in all directions *independently of each other* with respect to the connection points, and (g) gripping means proximate the second positions of the second and third members to allow gripping of appendages of the person's body to the second and third members, wherein movement of the gripping means is on a plane equidistant around the median position.

3. The device of claim 1, wherein *the second and third members are elongate,* the first and second positions on the second member are separated from each other along the length of the second member, and the first and second positions on the third member are separated *from each other* along the length of the third member, *whereby the gripping means are spaced from said universal connecting means.*

*10. The device as claimed in claim 1, wherein said force means is connected to said first member at two spaced locations on opposite sides of said median position and spaced from said pivot means.*

*11. The device as claimed in claim 1, wherein said pivot means defines a single, fixed pivot axis for pivoting of said first member relative to the frame.*

*12. A body building exercise device, comprising:*

*a rigid frame;*

*force directing means supported on the frame comprising a median position and first and second connection points on opposite sides of the median position;*

*pivot means to connect the force directing means to the frame to allow the connection points of the force directing means to move on two lines equally spaced apart from the median position;*

*resisting force means connected to the force directing means to provide a resisting force against movement of the connection points of the force directing means along the two lines, the connection between the force means and the force directing means being spaced from the pivot means;*

*first and second elongate members each having a first position and a second position;*

*a first universal connecting means connecting the first position of the first elongate member to the first connection point of the force directing means to allow pivotal movement of the first member in all directions with respect to the first connection point;*

*a second universal connecting means completely separate and independent from the first universal connecting means, the second universal connecting means connecting the first position of the second elongate member to the second connection point of the force directing means to allow pivotal movement of the second member in all directions with respect to the second connection point, whereby the pivotal movement in all directions of each member relative to the respective connection point is independent from the pivotal movement of the other member;*

*gripping means proximate the second positions of the first and second members and spaced from said universal connecting means to allow gripping of appendages of a person's body to the second and third members;*

*wherein movement of the gripping means is on a plane equidistant around the median position.*

*13. The device as claimed in claim 12, wherein said force means is connected to said force directing means at two locations spaced on opposite sides of said median position.*

*14. The device as claimed in claim 12, wherein said pivot means defines a fixed, non-adjustable pivot axis.*

*15. The device as claimed in claim 12, wherein said frame includes a base portion, and a seat for supporting a user mounted on said base portion, said first and second members extending on opposite sides of a seated user gripping said gripping means.*

*16. The device as claimed in claim 15, wherein said seat is positioned between said two equally spaced lines whereby pivoting of said force directing means about said pivot means causes said first and second connection points of said force directing means to pass said seat on opposite sides of said seat.*

*17. The device as claimed in claim 15, wherein said seat is positioned between said two equally spaced lines and is arranged such that said first and second connection points of said force directing means are capable of passing said seat on opposite sides of said seat when said force directing means is pivoted about said pivot means.*

* * * * *